US008390185B2

(12) United States Patent
Matsui et al.

(10) Patent No.: US 8,390,185 B2
(45) Date of Patent: Mar. 5, 2013

(54) BULB-TYPE LAMP

(75) Inventors: Nobuyuki Matsui, Osaka (JP); Noriyasu Tanimoto, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/062,926

(22) PCT Filed: Sep. 13, 2010

(86) PCT No.: PCT/JP2010/005589
§ 371 (c)(1),
(2), (4) Date: Mar. 8, 2011

(87) PCT Pub. No.: WO2011/030567
PCT Pub. Date: Mar. 17, 2011

(65) Prior Publication Data

US 2011/0241529 A1 Oct. 6, 2011

(30) Foreign Application Priority Data

Sep. 14, 2009 (JP) ..... 2009-212087

(51) Int. Cl.
*H01J 5/48* (2006.01)

(52) U.S. Cl. ..... 313/318.04; 362/275

(58) Field of Classification Search ..... 362/275, 362/287, 422, 419; 313/318.04
See application file for complete search history.

(56) References Cited

U.S. PATENT DOCUMENTS

| | | | | |
|---|---|---|---|---|
| 1,619,936 | A * | 3/1927 | Howe | 362/422 |
| 2,138,780 | A * | 11/1938 | Birdseye | 313/113 |
| 2007/0019398 | A1 | 1/2007 | Chen et al. | |
| 2008/0080187 | A1 * | 4/2008 | Purinton | 362/294 |
| 2009/0296412 | A1 * | 12/2009 | Ogawa et al. | 362/373 |
| 2010/0096992 | A1 | 4/2010 | Yamamoto et al. | |
| 2012/0127734 | A1 * | 5/2012 | Tanimoto et al. | 362/363 |

FOREIGN PATENT DOCUMENTS

| | | |
|---|---|---|
| JP | 2005-276466 | 10/2005 |
| JP | 2005-276467 | 10/2005 |
| JP | 3123535 | 6/2006 |
| JP | 2006-302532 | 11/2006 |
| JP | 2006-310207 | 11/2006 |
| JP | 2007-059260 | 3/2007 |
| JP | 2007-188832 | 7/2007 |
| JP | 2008-251444 | 10/2008 |
| JP | 2009-004130 | 1/2009 |
| JP | 2009-037995 | 2/2009 |
| JP | 2009-043447 | 2/2009 |

OTHER PUBLICATIONS

Japanese Patent Application No. 2012-194124 Office Action dated Nov. 27, 2012, 2 pages.

* cited by examiner

*Primary Examiner* — Nimeshkumar Patel
*Assistant Examiner* — Christopher Raabe

(57) ABSTRACT

Provided are a base 4 to be inserted into a socket by being rotated around a central axis X of the base, a first body 6 attached to the base 4 so as to be rotatable freely around the central axis X, a second body 8 attached to the first body 6, and a light-emitting module 10 mounted on the second body 8. The second body 8 is attached to the first body 6 so as to be swingable in a direction perpendicular to the central axis X.

5 Claims, 10 Drawing Sheets

BULB-TYPE LAMP

TECHNICAL FIELD

The present invention relates to bulb-type lamps, and in particular to bulb-type lamps having a relatively directive light-emitting element, such as a light-emitting diode (LED).

BACKGROUND ART

The use of bulb-type (compact) fluorescent lamps is increasing, as these lamps have a longer life expectancy and are more efficient than incandescent light bulbs, while being usable directly in sockets for incandescent light bulbs. Bulb-type LED lamps, which are easily made compact and have a life expectancy and efficiency superior even to bulb-type fluorescent lamps, have also become available. To permit replacement of incandescent light bulbs, such bulb-type lamps are provided with the same sort of base as incandescent light bulbs.

Bulb-type fluorescent lamps have been commercialized as a replacement for incandescent light bulbs, specifically for silica bulbs having an E26 base.

There is also a desire for a replacement light source to be developed for small light bulbs, of which mini krypton bulbs are representative. Mini krypton bulbs are smaller incandescent light bulbs than silica bulbs and have an E17 base. Due to constraints on size, however, it is difficult for a fluorescent bulb to achieve the desired brightness, and therefore use of LEDs is under study.

Current lighting fixtures that use mini krypton bulbs are typically downlights, and in at least 90% of these downlights, the bulb is inserted horizontally (i.e. so that the axis of the base is orthogonal to the vertical axis) or at a nearly horizontal inclination.

By contrast, typical bulb-type LED lamps (Patent Literature 1) are provided with an LED module that is a light-emitting module for shining light primarily in a forward direction along the axis of the base. Therefore, bulb-type LED lamps are not appropriate for the above downlight fixtures.

CITATION LIST

Patent Literature

Patent Literature 1: Japanese Patent Application Publication No. 2009-037995

Patent Literature 2: Japanese Patent Application Publication No. 2005-276467

Patent Literature 3: Japanese Patent Application Publication No. 2008-251444

SUMMARY OF INVENTION

Technical Problem

A bulb-type LED lamp having a body provided with an LED module that shines in a direction orthogonal to the axis of the base, and in which the body is rotatable around the axis of the base, has been proposed (Patent Literature 2). When this bulb-type LED lamp is attached horizontally to a lighting fixture, the lamp is adjusted to shine directly downwards by rotating the body. When attached to a lighting fixture at an inclination, however, the bulb-type LED lamp cannot illuminate a surface directly below the lighting fixture.

The present invention has been conceived in light of the above problems, and it is an object thereof to provide a bulb-type lamp that directs light from a light source (light-emitting module) towards a surface to be illuminated in accordance with the angle at which the bulb-type lamp is attached.

Solution to Problem

In order to achieve the above object, a bulb-type lamp according to the present invention comprises: a base to be inserted into a socket by being rotated around a central axis of the base; a first body attached to the base so as to be rotatable freely around the central axis; a second body attached to the first body; and a light-emitting module mounted on the second body, wherein the second body is swingable in a direction perpendicular to the central axis.

The bulb-type lamp may further comprise a whirl-stop configured to prevent the first body from rotating more than once around the central axis when the base is inserted into the socket with the first body or the second body being held.

Furthermore, the light-emitting module may include a printed circuit board and at least one LED chip mounted on a principal surface of the printed substrate, and the second body may be positioned with respect to the first body so that the principal surface is perpendicular to the central axis.

Advantageous Effects of Invention

With the base of the bulb-type lamp with the above structure inserted into a socket, the first body can be rotated around the base and the second body swung to match the direction of the surface to be illuminated. It is thus possible to swing the second body and direct the light from the light-emitting module towards the surface to be illuminated. In other words, regardless of the angle at which the bulb-type lamp is attached, light from the light-emitting module can be directed towards the surface to be illuminated.

BRIEF DESCRIPTION OF DRAWINGS

FIG. 4E is a right side view, all being views of the first body, whereas

DESCRIPTION OF EMBODIMENTS

Using an example of a bulb-type LED lamp, the following describes embodiments of the bulb-type lamp according to the present invention with reference to the drawings.

Embodiment 1

Figure 1A:
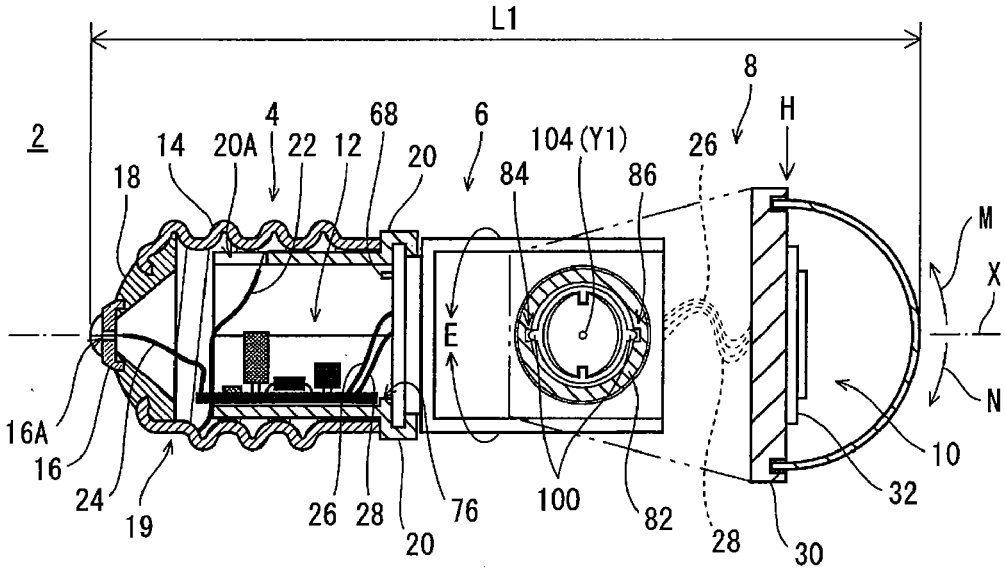
FIGS. 1A and 1B show a structure of a bulb-type LED lamp according to Embodiment 1.
Figure 1B:
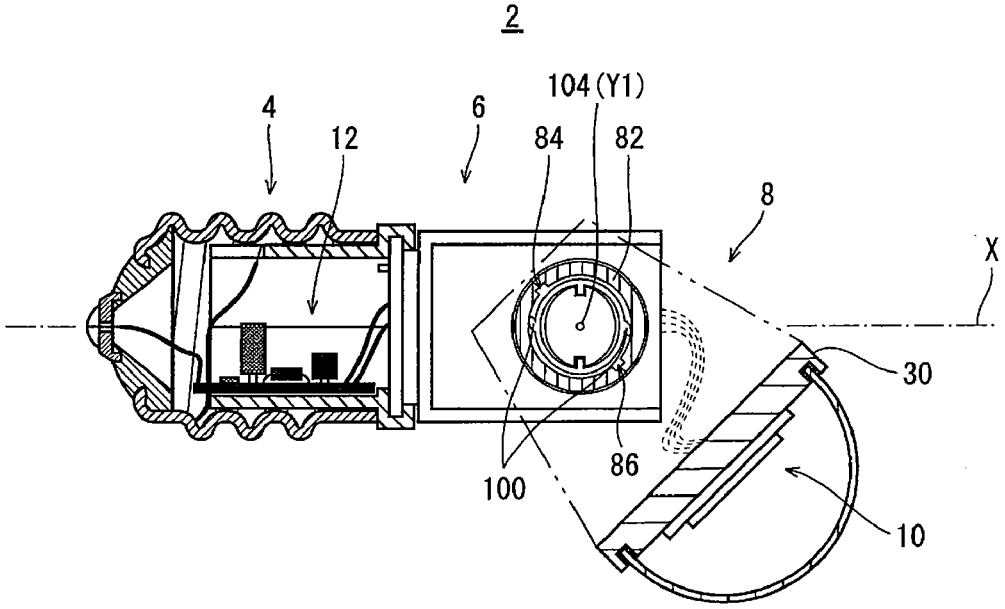

FIGS. 1A and 1B show a structure of a bulb-type LED lamp 2 according to Embodiment 1. Note that in FIGS. 1A and 1B, a portion of a second body 8 has been represented by lines with alternate long and two short dashes in order to clearly illustrate the mechanism for changing the relative angle between a first body 6 and the second body 8, as described below.

The bulb-type LED lamp 2 includes a base 4, the first body 6, and the second body 8 connected in this order. An LED module 10 is attached to the second body 8 as an example of a light-emitting module. A lighting circuit unit 12 for lighting the LED module 10 is stored in the base 4.

The base 4 complies with Japanese Industrial Standards (JIS), for example with standards for an E17 base, and is used in sockets for general incandescent light bulbs (not shown in the figures). Note that the base 4 is not limited in this way, but may be a different size, such as the size specified by the standards for an E26 base.

The base 4 includes a shell 14, also called a cylindrical section, and an eyelet 16 shaped like a circular dish. The shell 14 and the eyelet 16 are integrated, with a glass first insulating unit 18 therebetween. An integral base body 19 composed of the shell 14, eyelet 16, and first insulating unit 18 is inserted into a second insulating unit 20 that has an overall cylindrical shape.

A slit 20A is provided in the second insulating unit 20. A first electric supply line 22 for supplying electric power to the lighting circuit unit 12 is drawn through the slit 20A and out of the second insulating unit 20.

A lead section of the first electric supply line 22 is sandwiched between the inner surface of the shell 14 and the outer surface of the second insulating unit 20. The first electric supply line 22 and the shell 14 are thus electrically connected.

The eyelet 16 has a through-hole 16A provided in a central region thereof. A lead section of a second electric supply line 24 for supplying power to the lighting circuit unit 12 is drawn through the through-hole 16A and is attached to the outer surface of the eyelet 16 with solder.

The lighting circuit unit 12 converts commercial 100V alternating-current power provided via the base 4 to direct-current power of a predetermined voltage and supplies the direct-current power to the LED module 10.

The lighting circuit unit 12 and the LED module 10 are electrically connected by a first lead wire 26 and a second lead wire 28.

The LED module 10 is attached to a mount 30 in the second body 8.

Figure 2B:
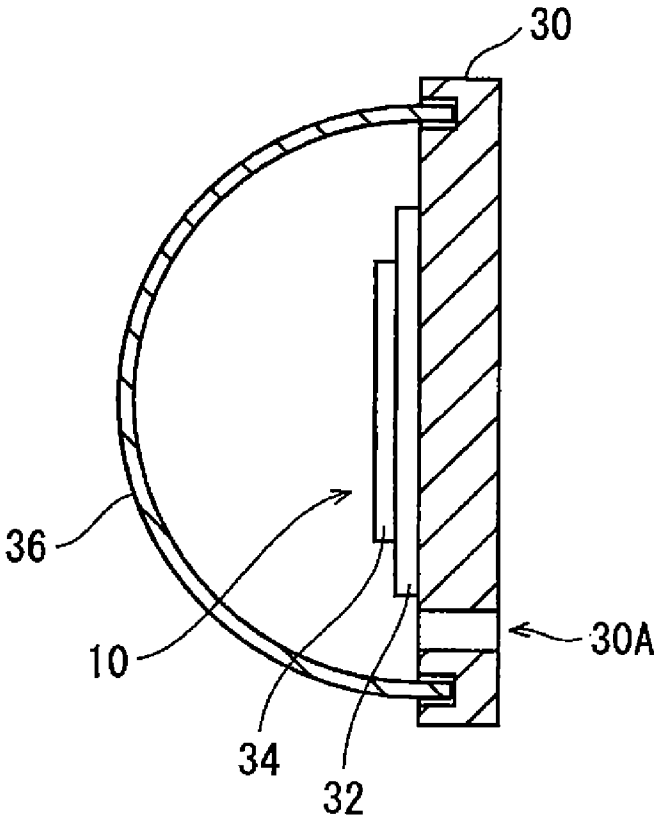
FIG. 2B is a cross-section diagram along the line A-A in FIG. 2A.
Figure 2A:
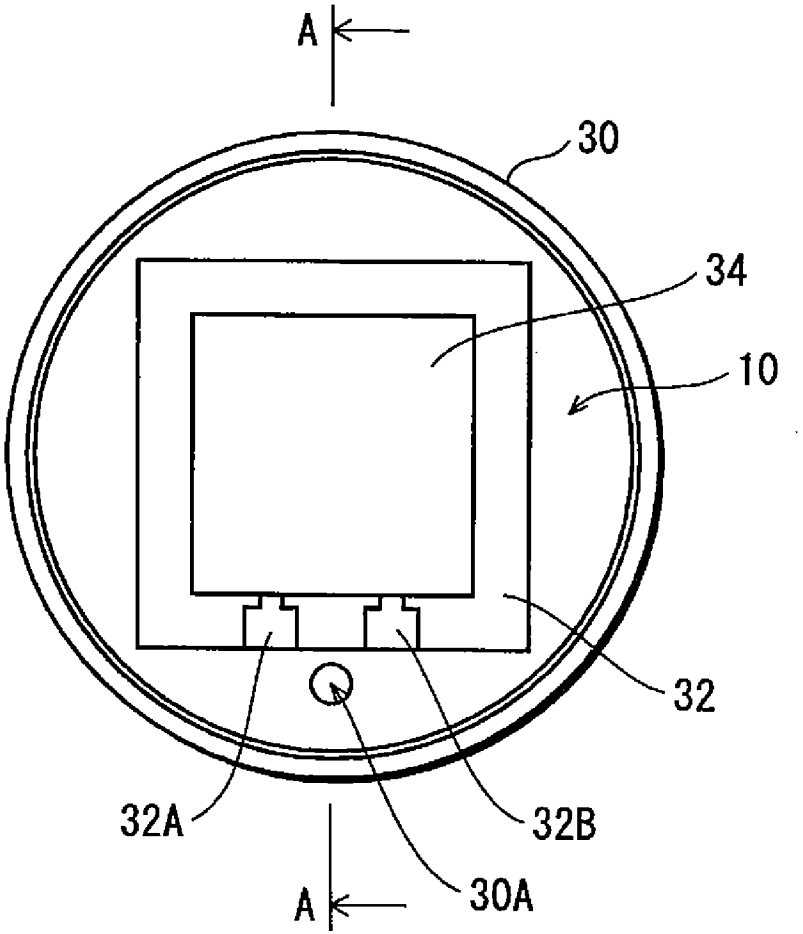
FIG. 2A is a plan view of an LED module attached to a mount.

FIG. 2A is a plan view of the LED module 10 attached to the mount 30, and FIG. 2B is a cross-section diagram along the line A-A in FIG. 2A.

The LED module 10 has a rectangular printed circuit board 32. A plurality of LED chips (not shown in the figures), which are light-emitting elements, are mounted on the printed circuit board 32. These LED chips are connected in series by the wiring pattern (not shown in the figures) of the printed circuit board 32. Among the LED chips connected in series, the anode of the LED chip at the high-potential edge (not shown in the figures) is electrically connected to a power supply land 32A, and the cathode of the LED chip at the low-potential edge (not shown in the figures) is electrically connected to a power supply land 32B. The LED chips emit light by receiving power from the power supply lands 32A and 32B. Each LED chip may, for example, emit blue light having a peak wavelength between 420 nm and 480 nm or ultraviolet light having a peak wavelength between 340 nm and 420 nm. Note that only one LED chip may alternatively be used in the LED module 10. When multiple LED chips are used, they need not be connected in series as described above. Series-parallel connection is also possible. That is, groups of LED chips may be connected in parallel, with each group formed from a predetermined number of LED chips connected in series, or alternatively, groups of LED chips may be connected in series, with each group formed from a predetermined number of LED chips connected in parallel. The power supply lands in the LED module 10 need not be provided as two electrodes at one end as above. Alternatively, one electrode may be provided at each end. The power supply lands in the LED module 10 need not be provided as two electrodes, but may be a plurality of electrodes. In such an LED module 10 with a variety of electrodes, the first lead wire 26 and the second lead wire 28 from the lighting circuit unit 12 may be freely routed, and furthermore the location and shape of a hole 30A through which the first lead wire 26 and the second lead wire 28 pass can be designed more freely.

A translucent phosphor layer 34 is coated on the LED chips. The phosphor layer 34 is formed by distributing, on a translucent resin such as silicone, greenish yellow phosphor particles $(Ba,Sr)_2SiO_4:Eu^{2+}$ or $Y_3(Al,Ga)_5O_{12}:Ce^{3+}$, or these greenish yellow phosphor particles and red phosphor particles such as $Sr_2Si_5N_8:Eu^{2+}$, $(Ca,Sr)S:Eu^{2+}$, or $(Ca,Sr)AlSiN_3:Eu^{2+}$ etc. In addition to the phosphor materials listed above, the following may also be used. As a yellow phosphor, $Y_3Al_5O_{12}:Ce^{3+}$ (YAG:Ce); $Y_3Al_5O_{12}:Tb^{3+}$, i.e. terbium (Tb)-activated YAG; $Y_3Al_5O_{12}:Ce^{3+}$, $Pr^{3+}$, i.e. cerium (Ce) and praseodymium (Pr)-activated YAG; a thiogallate phosphor $CaGa_2S_4:Eu^{2+}$; or an α-sialon phosphor Ca-α-SiAlON:$Eu^{2+}$ $(0.75(Ca_{0.9}Eu_{0.1})O.2.25\ AlN.3.25\ Si_3N_4:Eu^{2+}$, $Ca_{1.5}Al_3Si_9N_{16}:Eu^{2+}$, etc.) may be used. As a green phosphor, an aluminate phosphor $BaMgAl_{10}O_{17}:Eu^{2+}$, $Mn^{2+}$, $(Ba,Sr,Ca)Al_2O_4:Eu^{2+}$; an α-sialon phosphor $Sr_{1.5}Al_3Si_9N_{16}:Eu^{2+}$; Ca-α-SiAlON:$Yb^{2+}$; a β-sailon phosphor $\beta\text{-}Si_3N_4:Eu^{2+}$; oxonitridosilicate $(Ba,Sr,Ca)Si_2O_2N_2:Eu^{2+}$, oxonitridoaluminosilicate $(Ba,Sr,Ca)_2Si_4AlON_7:Ce^{3+}$, or $(Ba,Sr,Ca)Al_{2-x}Si_xO_{4-x}N_x:Eu^{2+}$ $(0<x<2)$, which are oxynitride phosphors; nitridosilicate phosphor $(Ba,Sr,Ca)_2Si_5N_8:Ce^{3+}$ which is a nitride phosphor; a thiogallate phosphor $SrGa_2S_4:Eu^{2+}$; a garnet phosphor $Ca_3Sc_2Si_3O_{12}:Ce^{3+}$, $BaY_2SiAl_4O_{12}:Ce^{3+}$, etc. may be used. As an orange phosphor, α-sailon phosphor Ca-α-SiAlON:$Eu^{2+}$, etc. may be used. As a red phosphor, $(Y,Gd)_3Al_5O_{12}:Ce^{3+}$, a sulfide phosphor $La_2O_2S:Eu^3\pm,Sm^{3+}$, a silicate phosphor $Ba_3MgSi_2O_8:Eu^2\pm,Mn^{2+}$, a nitride or oxynitride phosphor $(Ca,Sr)SiN_2:Eu^{2+}$, $(Ca,Sr)AlSiN_3:Eu^{2+}$ or $Sr_2Si_5,Al_xO_xN_{8-x}:Eu^{2+}$ $(0\leqq x\leqq 1)$, etc. may be used. When only using greenish yellow phosphor particles, the white color rendering properties are low (Ra<80), but luminous efficiency is high. On the other hand, when mixing greenish yellow and red phosphor particles, the luminous efficiency of white light becomes lower, but the color rendering properties are higher (Ra≧80), thus achieving light that is better suited as an illumination light source.

In a blue LED chip, when greenish yellow and red phosphor particles are used in the phosphor layer 34, a portion of the blue light emitted from the LED chip is absorbed in the phosphor layer 34 and converted into greenish yellow or red light. Blue, greenish yellow, and red light combine to form white light, which is emitted mainly from the upper surface (light-emitting surface) of the phosphor layer 34. The "light-emitting direction" of the LED module 10 is defined here as the direction perpendicular to the surface on which the LED chip (not shown in the figures) is mounted on the printed circuit board 32.

The mount 30 for the LED module 10 has an overall disc shape. The back surface of the printed circuit board 32 is attached to a principle surface of the mount 30 with a highly heat-conductive paste. Note that the printed circuit board 32 need not be attached to the mount 30 with a highly heat-conductive paste, but may be attached with a highly heat-conductive sheet. Alternatively, a different fixing means may be used, such as fixing the edge of the printed circuit board 32 with a screw, pressing on the printed circuit board 32 through the socket, etc. As long as the temperature of the LED chip is lowered by efficiently transmitting heat from the LED chip to the mount 30, the fixing means is not limited. Furthermore, in addition to a resin-based substrate, such as a paper-phenolic substrate or a glass epoxy substrate, the printed circuit board 32 may have a ceramic substrate such as alumina, a metal-based substrate in which a resin-based insulating layer is affixed to a metal such as aluminum, etc.

The mount 30 is aluminum and also functions as a heatsink for releasing heat produced by the LED module 10. On the mount 30, a hole 30A is formed for the first and second lead wires 26, 28 to pass through. After being passed through the hole 30A, the first and second lead wires 26, 28 are respectively connected to the first and second power supply lands 32A, 32B (connection not shown in the figures).

A globe 36 is attached to the mount 30, covering the LED module 10. The globe 36 is formed from a transparent material such as glass or synthetic resin. In order to increase the average amount of light emitted from the globe, an increase in diffuseness is often sought. To this end, a film of silica power is often formed on the inner surface of the globe.

Returning to FIG. 1, the base 4 is inserted into a socket (not shown in the figures) of, for example, a downlight fixture. Insertion refers, of course, to the base 4 being screwed into the socket by being rotated. The central axis (imaginary axis) of rotation at this time is defined as X.

The first body 6 is attached to the base 4 so as to be rotatable around the central axis X. The second body 8 is attached to the first body 6 so that the angle with respect to the central axis X can be changed. An example of a structure for the first body 6 to be rotatable and for the angle of the second body 8 to be changeable is described below.

Figure 3:
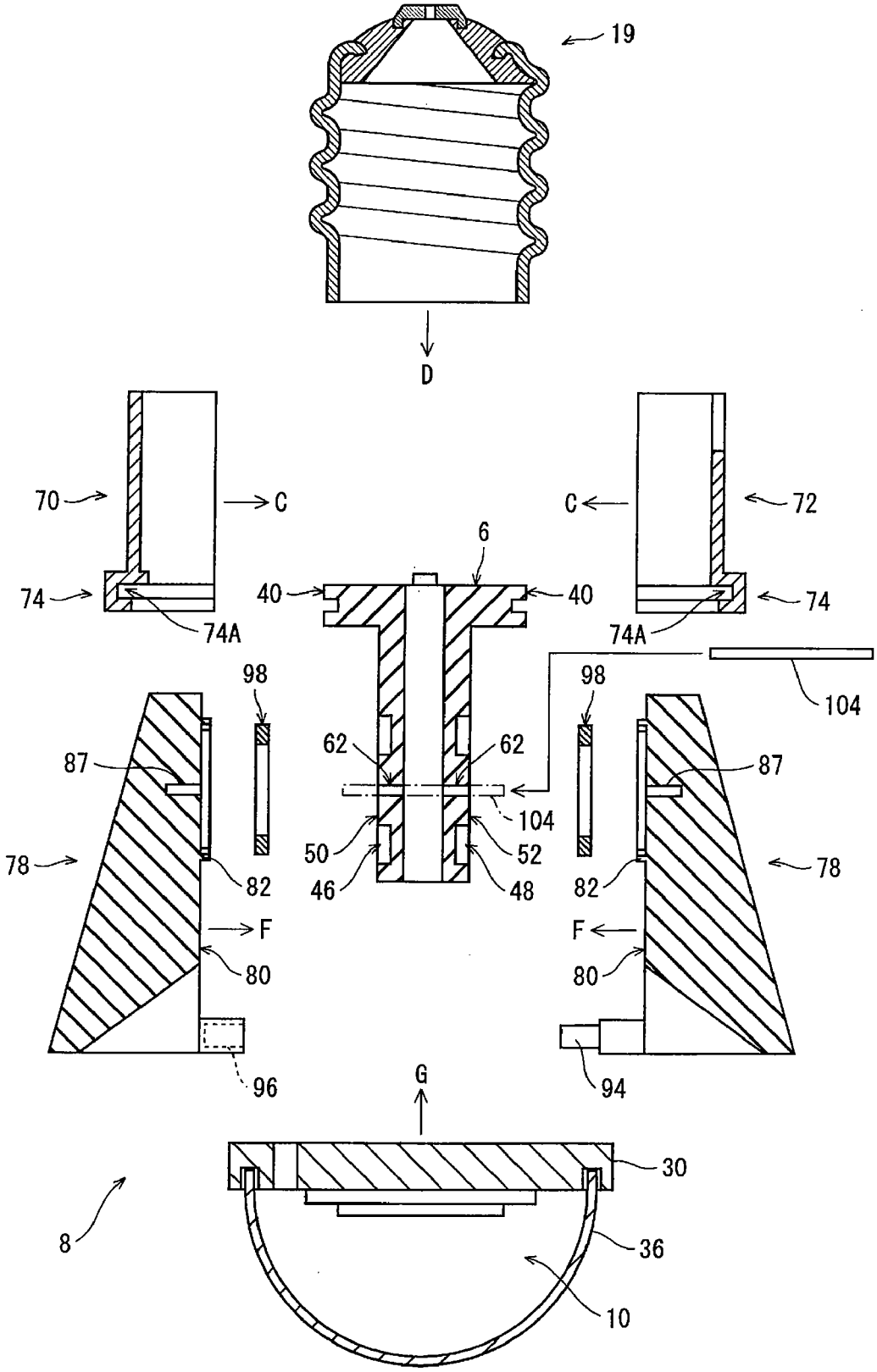
FIG. 3 is an exploded view of a base, first body, and second body, in which each component is drawn as a cross-section diagram.

FIG. 3 is an exploded view of the base 4, first body 6, and second body 8, in which each component is drawn as a cross-section diagram. The following describes each component in detail, while also describing assembly of the components with reference to FIG. 3.

Figure 4B:
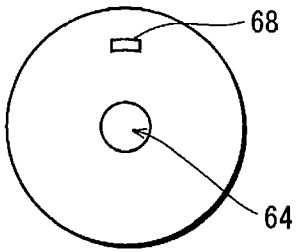
FIG. 4B is a plan view.
Figure 4A:
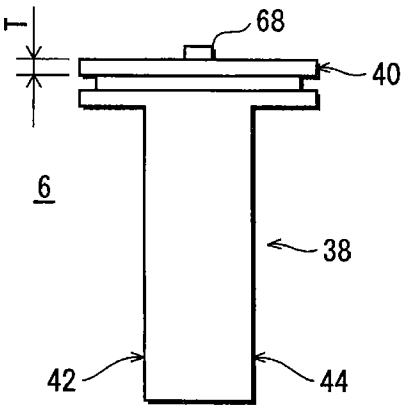
FIG. 4A is a front view.
Figure 4C:
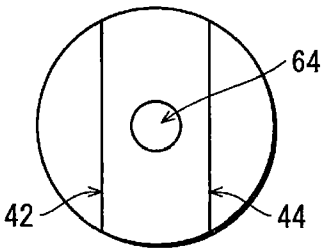
FIG. 4C is a bottom view.
Figure 4D:
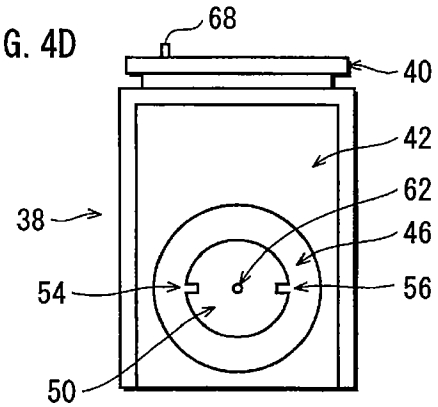
FIG. 4D is a left side view.
Figure 4E:
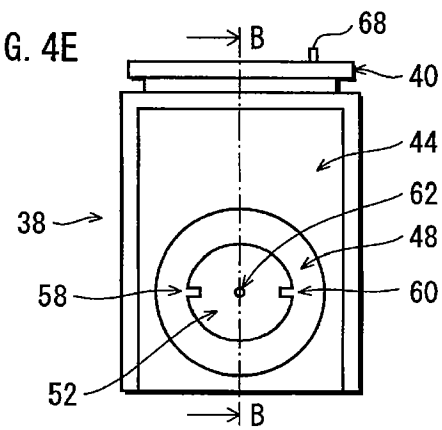
Figure 4F:
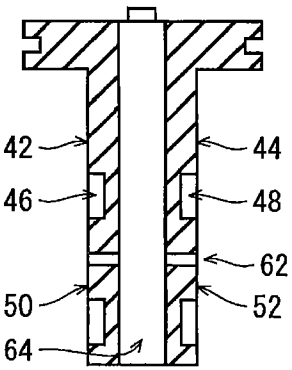
FIG. 4F is a cross-section diagram along the line A-A in FIG. 4E.

FIGS. 4A-4F show the first body 6. FIG. 4A is a front view, FIG. 4B is a plan view, FIG. 4C is a bottom view, FIG. 4D is a left side view, and FIG. 4E is a right side view, all being views of the first body, whereas FIG. 4F is a cross-section diagram along the line A-A in FIG. 4E.

The first body 6 has a second body attachment unit 38 and a base connection unit 40. The second body attachment unit 38 is formed in the shape of a thick-wall cylinder with two lateral sides. The base connection unit 40 is located at one end of the second body attachment unit 38 and is shaped as a circular flange.

The two parallel lateral sides 42 and 44 (hereinafter, "first side 42" and "second side 44") of the second body attachment unit 38 are respectively provided with circular concavities 46 and 48 (hereinafter, "first concavity 46" and "second concavity 48"). The first concavity 46 and second concavity 48 are respectively provided, at the center thereof, with convexities 50 and 52 (hereinafter, "first convexity 50" and "second convexity 52") that have an overall shape of an elliptic cylinder.

The first convexity 50 and second convexity 52 shaped as elliptic cylinders are provided, at the edges of the major axes thereof, with rectangular notches 54, 56, 58, and 60.

The first body 6 has a through-hole 62 at the center of the first convexity 50 and the second convexity 52 in a direction of height thereof.

The first body 6 also has a through-hole 64 in the direction of length thereof, through which the first and second lead wires 26, 28 (FIG. 1) pass.

Furthermore, the first body 6 has a projection 68 that projects from an end surface of the base connection unit 40.

The first body 6 is formed from a highly heat-conductive material such as ceramics, or aluminum, copper, or other metal, or from an organic material, such as a resin packed with a high density of highly heat-conductive filler.

FIGS. 5A-5D and 6A-6D show a first half-cylinder member 70 and a second half-cylinder member 72 that are components of the second insulating unit 20 of the base 4 (FIG. 1).

Figure 5B:
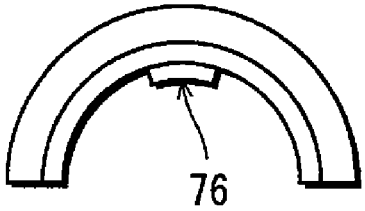
FIG. 5B is a plan view.
Figure 5A:
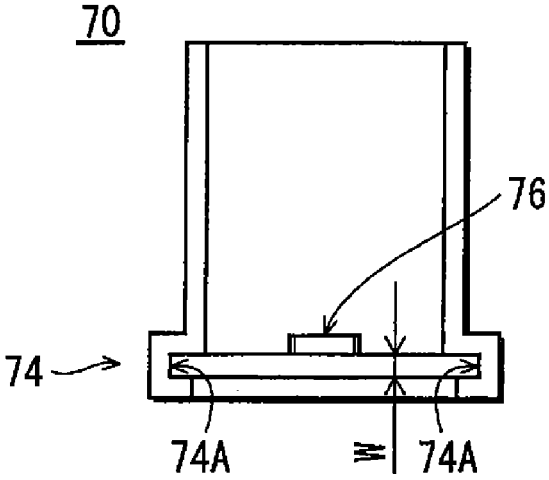
FIG. 5A is a front view.
Figure 5D:
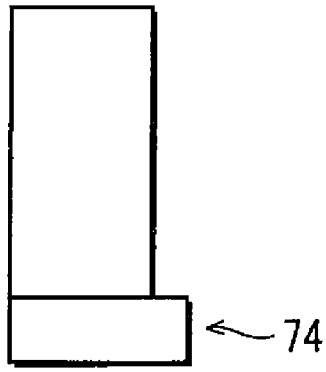
FIG. 5D is a right side view, all being views of a first half-cylinder member.
Figure 5C:
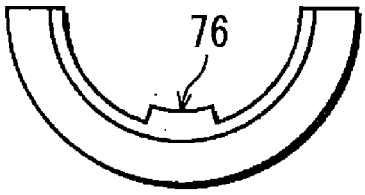
FIG. 5C is a bottom view.

FIG. 5A is a front view, FIG. 5B is a plan view, FIG. 5C is a bottom view, and FIG. 5D is a right side view, all being views of the first half-cylinder member 70. Note that the left side view is represented in the same way as the right side view, and thus a description thereof is omitted.

As shown in FIGS. 5A-5D, the first half-cylinder member 70 has an overall shape of a half-cylinder, as its name indicates. At one edge in the direction of length, the first half-cylinder member 70 has a U-shaped section protruding diametrically. This protrusion forms half of a first body connection unit 74 described below. The first half-cylinder member 70 also has a projection 76 projecting from an inner surface thereof.

Figure 6B:
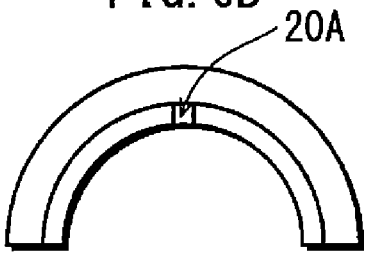
FIG. 6B is a plan view.
Figure 6A:
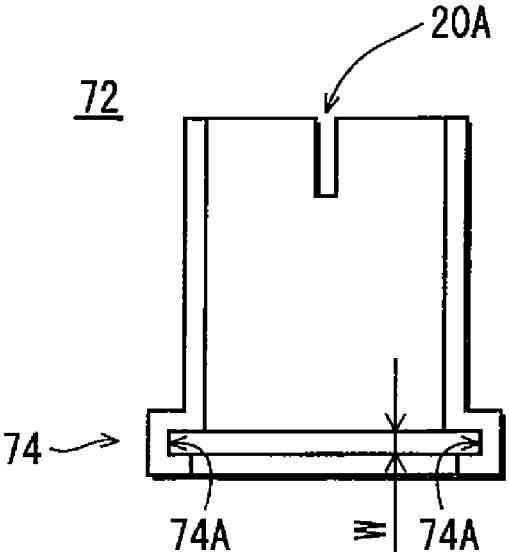
FIG. 6A is a front view.
Figure 6D:
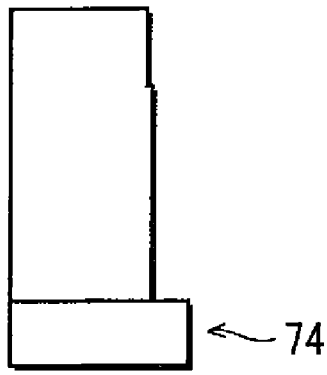
FIG. 6D is a right side view, all being views of a second half-cylinder member.
Figure 6C:
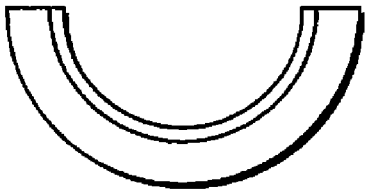
FIG. 6C is a bottom view.

FIG. 6A is a front view, FIG. 6B is a plan view, FIG. 6C is a bottom view, and FIG. 6D is a right side view, all being views of the second half-cylinder member 72. Note that the left side view is represented in the same way as the right side view, and thus a description thereof is omitted.

As shown in FIGS. 6A-6D, the second half-cylinder member 72 has an overall shape of a half-cylinder, as its name indicates. At one edge in the direction of length, the second half-cylinder member 72 has a U-shaped section protruding diametrically. This protrusion forms the other half of the first body connection unit 74. The slit 20A (FIG. 1) is provided at the other edge of the second half-cylinder member 72.

As described below, the base connection unit 40 (FIG. 4A) of the first body 6, shaped as a circular flange, is inserted into a groove 74A inside the U-shaped protruding section of the first body connection unit 74 in the first half-cylinder member 70 and second half-cylinder member 72. The width W (FIGS. 5A, 6A) of the groove 74A is set to be slightly shorter than the thickness T of the base connection unit 40 shown in FIG. 4A.

Note that the first half-cylinder member 70 and second half-cylinder member 72 are formed from synthetic resin, which is an insulating material.

Returning to FIG. 3, assembly of the integral base body 19, first half-cylinder member 70, second half-cylinder member 72, and first body 6 is described. Note that in the description below of the assembly with reference to FIG. 3, no mention is made of the lighting circuit unit 12, first electric supply line 22, second electric supply line 24, first lead wire 26, and second lead wire 28.

First, the first half-cylinder member 70 and second half-cylinder member 72 are brought together in the direction indicated by the arrows C to form the second insulating unit 20 (FIG. 1). At this point, the base connection unit 40 of the first body 6, shaped as a circular flange, is inserted into the groove 74A with a U-shaped cross-section in the first body connection unit 74. Since the width W (FIGS. 5A, 6A) of the groove 74A is set to be slightly shorter than the thickness T of the base connection unit 40 shown in FIG. 4A, the first body connection unit 74 of the first half-cylinder member 70 and the second half-cylinder member 72 elastically deforms, and the width W of the groove 74A slightly expands.

Once the second insulating unit 20 is formed, the integral base body 19 is placed over the second insulating unit 20. The integral base body 19 and the second insulating unit 20 are connected with an adhesive or the like, not shown in the figures.

The first body 6 is thus attached to the base 4 so as to be rotatable relatively freely in the directions of the arrows E around the central axis X shown in FIG. 1A. The base connection unit 40 is sandwiched due to the restoring force of the first body connection unit 74 that has elastically deformed, and therefore the first body 6 does not rotate around the base 4 arbitrarily.

Next, details on the second body 8, and on the assembly (connection) of the second body 8 and the first body 6, are provided.

FIGS. 7A-7E show one block member 78 of a pair of block members that are components of the second body 8. Note that two of the same block members 78 form the pair.

Figure 7E:
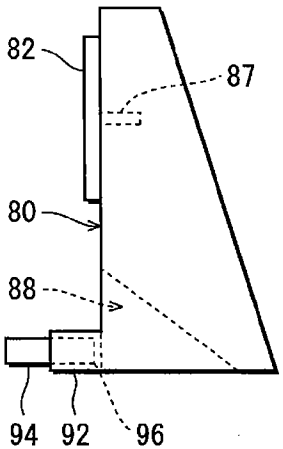
FIG. 7E is a right side view, all being views of a block member.
Figure 7B:
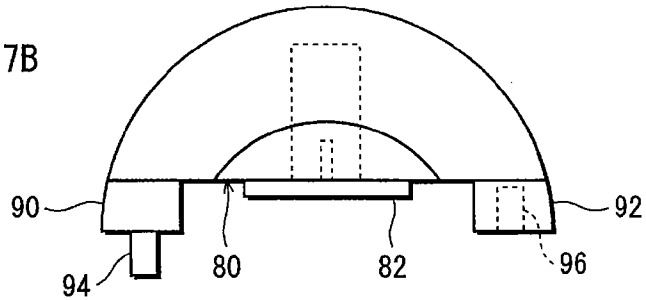
FIG. 7B is a plan view.
Figure 7A:
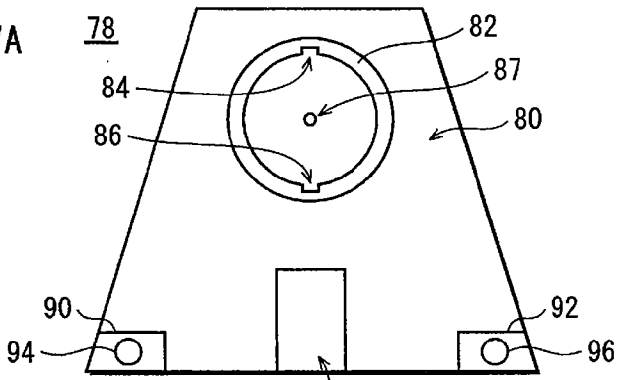
FIG. 7A is a front view.
Figure 7C:
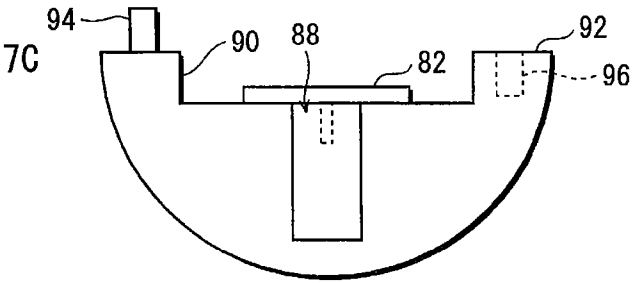
FIG. 7C is a bottom view.
Figure 7D:
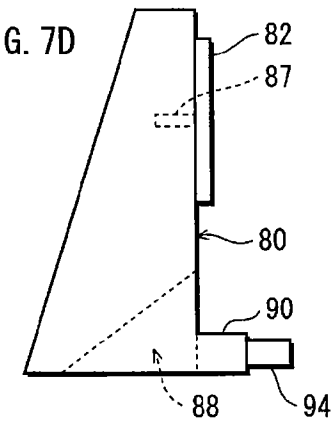
FIG. 7D is a left side view.

FIG. 7A is a front view, FIG. 7B is a plan view, FIG. 7C is a bottom view, FIG. 7D is a left side view, and FIG. 7E is a right side view, all being views of the block member 78.

The block member 78 has an overall shape of a semi-circular truncated cone. A protrusion 82 that is annular (hereinafter, "annular protrusion") is formed on a perpendicular wall 80 in FIGS. 7A-7E. Along the inner circumference of the annular protrusion 82, rectangular shaped notches 84 and 86 are provided vertically opposite to each other.

At the center of the annular protrusion 82, an insertion-hole 87 into which a shaft 104 (FIG. 3) is inserted, as described below, is provided on the wall 80.

A slit 88 is cut diagonally into the center of the bottom of the wall 80. A portion of the first lead wire 26 and the second lead wire 28 pass through the slit 88.

At the bottom edges of the wall 80, projections 90 and 92 are provided. A pin 94 extends from one of the projections, projection 90, whereas a hole 96 is formed in the other projection, projection 92.

Figure 8:
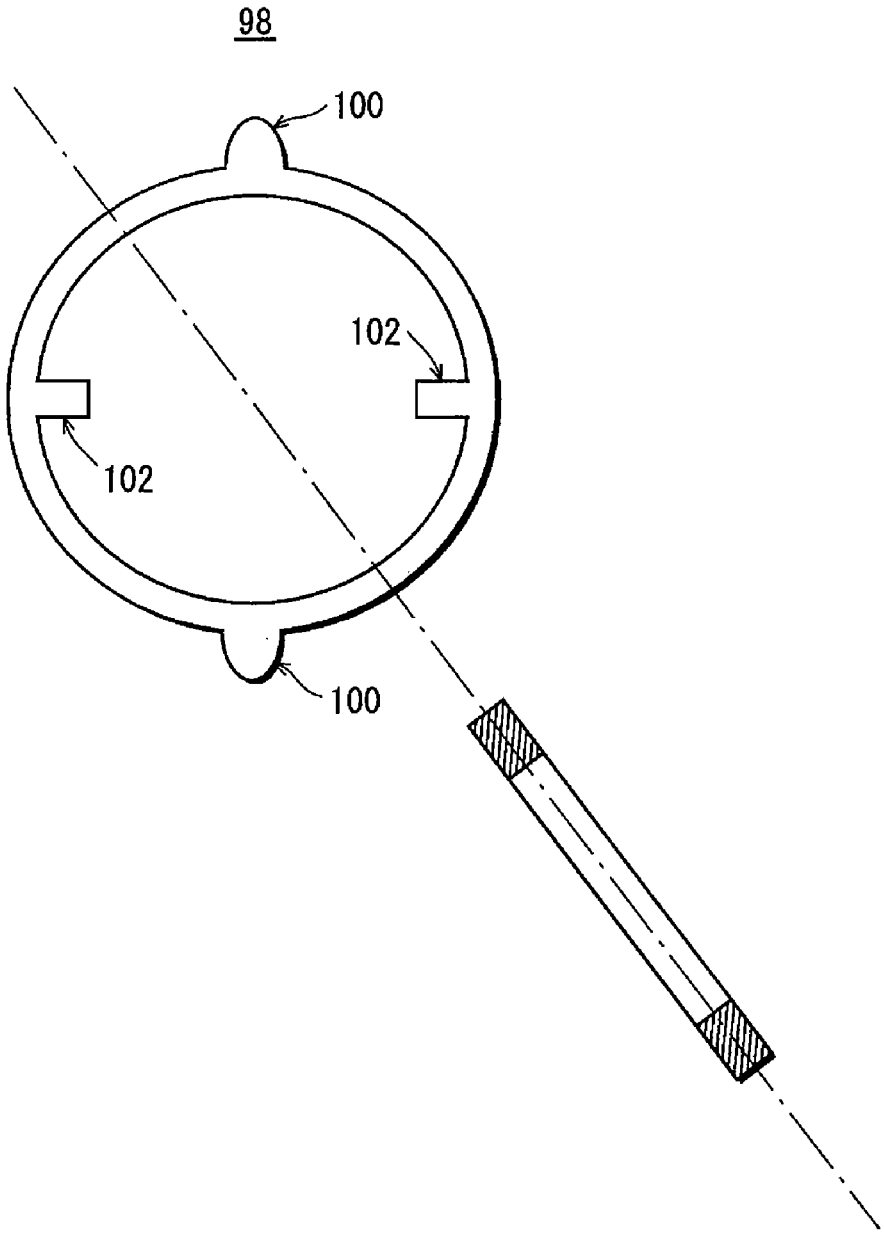
FIG. 8 shows a ring member.

FIG. 8 shows a ring member 98. The ring member 98 is formed from silicone rubber. Note that the ring member 98 is not limited to silicone rubber, so long as an elastic material with heat resistance such as polycarbonate resin, acrylic resin, etc. is used. The ring member 98 has a pair of outer projections 100 protruding from the outer peripheral surface, as well as a pair of inner projections 102 protruding from the inner peripheral surface.

Returning to FIG. 3, attachment of the pair of block members 78 and the first body 6 is described.

Before attaching the block members 78, the shaft 104 is pressed into the through-hole 62 in the first body 6 into the position indicated by the alternating long and short dashed line.

Next, a ring member 98 is inserted into each of the first concavity 46 and the second concavity 48 of the first body 6. The inner projections 102 (FIG. 8) of the ring members 98 are aligned so as to be inserted into the notches 54, 56, 58, and 60 (FIG. 4) in the first convexity 50 and the second convexity 52.

The two block members 78 are pushed together as indicated by the arrows F, with the walls 80 thereof facing each other. Either edge of the shaft 104 is inserted into the insertion-hole 87 of one of the block members 78, whereas the pin 94 is pressed into the opposing hole 96. The annular protrusions 82 of the block members 78 are respectively inserted into the first concavity 46 and the second concavity 48. Note that the shaft 104 and the insertion-holes 87 are engaged by a clearance fit. The shaft 104 does not fit into the block member 78 loosely, yet can rotate relatively smoothly.

When the pair of block members 78 is integrated as described above (i.e. upon completion of assembly), then starting with the shaft 104 at the center, the first convexity 50, ring member 98, and annular protrusion 82 are located in this order in the first concavity 46, and the second convexity 52, ring member 98, and annular protrusion 82 are located in this order in the second concavity 48.

After completion of assembly of the pair of block members 78, the mount 30, on which the LED module 10 is provided, is attached at the bottom to the block members 78 with heat resistant adhesive or the like.

Note that attachment is not limited in this way. Alternatively, at least two pins may be provided at appropriate positions on the bottom of the mount 30, with corresponding press fittings provided on the surface of the block members 78, so that the mount 30 and the block members 78 are connected by pressing the pins into the press fittings.

Alternatively, a plurality of through-holes may be provided on the mount 30, with corresponding threaded holes provided on the surface of the block member 78, so that the mount 30 and the block members 78 may be fastened with screws. Preferably, heat from the LED module should be transmitted to the block members 78 through the mount 30.

After the pair of block members 78 is integrated as described above (i.e. upon completion of assembly), the spaces between the first convexity 50, ring member 98, and annular protrusion 82, which are located in the first concavity 46 starting with the shaft 104 at the center, as well as the space between the first body 6 and the second body 8, are filled with highly heat-resistant paste. Heat from the LED module that is transferred to the mount 30 and the block members 78 is thus transferred efficiently to the first body 6, thereby further reducing the temperature of the LED module and achieving a reliable bulb-type LED light source with high luminous flux.

When the bulb-type LED lamp 2 is assembled as above, the outer projections 100 of the ring members 98 are inserted into the notches 84, 86 of the annular protrusions 82 to yield a basic position in which the principle surface of the printed circuit board 32 in the LED module 10 is perpendicular to the central X axis, as shown in FIG. 1A. In other words, the lamp has a basic position in which light is emitted along the central X axis.

In this basic position, the bulb-type LED lamp 2 is held by the first body 6 or the second body 8 and rotated to insert the base 4 into a socket (not shown in the figures) of a lighting fixture. In particular, in the case of a downlight fixture in which krypton bulbs are used, the space for attaching the bulb is narrow, meaning that it would often be easier to rotate the lamp while holding the second body 8. When holding the second body 8, even if the socket increasingly resists screwing of the base 4 partway through insertion, the projection 68 provided on the first body 6 acts as a whirl-stop, coming into contact with the projection 76 provided on the second insulating unit 20 of the base 4 and preventing the first body from rotating more than one turn (360 degrees) with respect to the base 4.

By pushing the second body 8 from the basic position in the direction of the arrow H, the second body 8 rotates (swings) relative to the first body 6 around the shaft 104 of the second body 8. At this point, as shown in FIG. 1B, the outer projections 100 detach from the notches 84, 86 and deform elastically to press against the inside of the annular protrusions 82. The outer projections 100 press against the inside of the annular protrusions 82, and due to the resulting friction, the second body 8 may be brought to rest (i.e. positioned) at any angle with respect to the first body 6.

The second body 8 is thus attached to the first body 6 so as to be rotatable around the shaft 104, and the angle of the second body 8 with respect to the central axis X is changeable by rotating the second body 8 around the shaft 104 (i.e. by swinging the second body 8).

This angle may be changed to exceed a 90 degree angle that is perpendicular to the central X axis in FIGS. 1A and 1B (i.e. the angular width is equal to or greater than 180 degrees). In other words, the second body 8 can be swung around an imaginary central axis (hereinafter, a "swing axis") of the shaft 104 that is perpendicular to (i.e. in planar intersection with) the central axis X.

Accordingly, if the central axis of the socket of a lighting fixture not shown in the figures is horizontal, resulting in the central axis X being horizontal when the base 4 is inserted into the socket, then (i) the first body is rotated around the central axis X with respect to the base 4, so that the second body 8 swings in a perpendicular direction, and (ii) the second body 8 is rotated, so as to direct the LED module 10 perpendicularly downwards (so as to direct emitted light perpendicularly downwards).

Even if the central axis of the socket is inclined (i.e. between horizontal and perpendicular), the LED module 10 (emitted light) is directed perpendicularly downwards by appropriately swinging the second body 8 to adjust the angle of the second body 8 with respect to the central axis X.

Embodiment 2

Figure 9A:
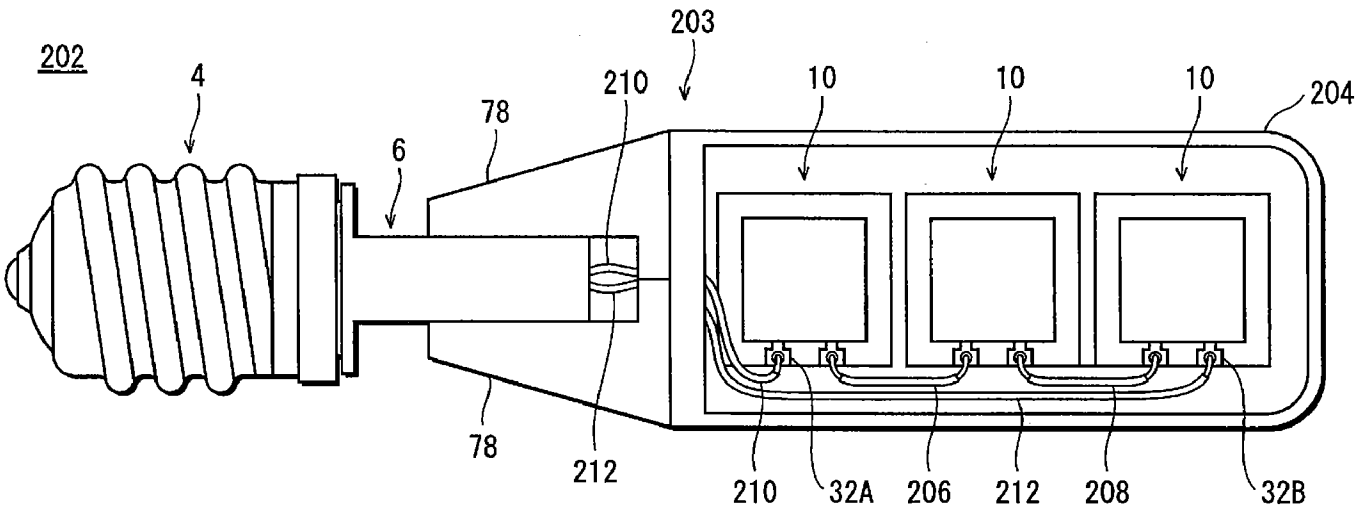
FIGS. 9A and 9B show a structure of an LED lamp according to Embodiment 2.
Figure 9B:
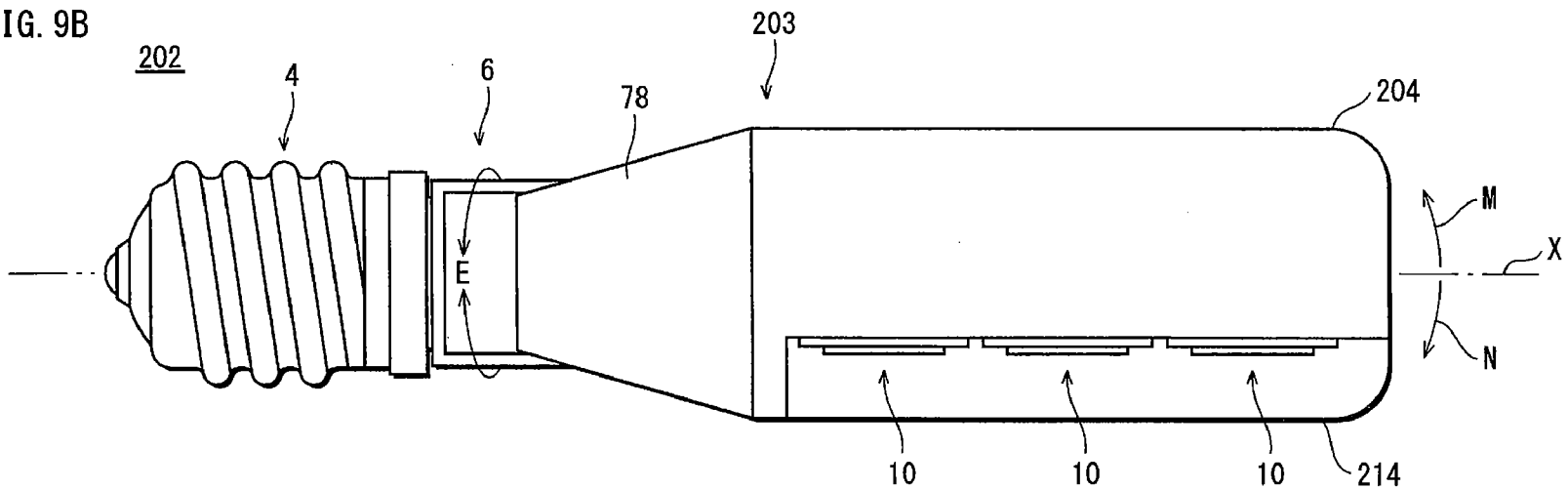

FIG. 9A shows a plan view of an LED lamp 202 according to Embodiment 2, and FIG. 9B shows a bottom view of the same.

The LED lamp 202 has the same basic structure as the bulb-type LED lamp 2 (FIGS. 1A, 1B, 2A, and 2B) according to Embodiment 1, except for the shape of the mount, which is a component of the second body, and for the number of LED modules used. Accordingly, in FIG. 9, components that are the same as in Embodiment 1 bear the same reference signs, and a description thereof is omitted. The following description focuses on the above differences.

The mount 204, which is a component of the second body 203 in the LED lamp 202, is aluminum and also functions as a heatsink for releasing heat produced by the LED modules 10, as in Embodiment 1.

A portion of the cylindrical, outer peripheral surface of the mount 204 is cut away in a direction of length thereof, and a rectangular, flat surface is formed. This flat surface forms a module mounting surface 204A.

Three LED modules 10 are mounted in a row on the module mounting surface 204A. The three LED modules 10 are electrically connected in series, with the LED module 10 in the middle connected to the LED modules 10 on either side respectively by internal wires 206 and 208.

A power supply land 32A for the LED module 10 at the high-potential edge and a power supply land 32B for the LED module 10 at the low-potential edge are respectively connected to a lighting circuit unit (not shown in the figures) by a first lead wire 210 and a second lead wire 212. Note that through-holes (not shown in the figures) are provided in the mount 204 connecting to the slit 88 (FIG. 7A) in the block members 78, and the first lead wire 210 and second lead wire 212 are inserted through the corresponding through-hole.

A globe 214 is attached to the mount 204, covering the three LED modules 10. The materials for the globe 214 and treatment applied to the globe 214 are the same as the globe 36 in Embodiment 1.

In this example, a plurality of LED chips form an LED module 10, and a plurality of LED modules 10 (in this example, three) are used, thus achieving even higher luminance. This light source may, for example, be used as an alternative to a high-intensity discharge (HID) lamp.

In this case, since the number of LED chips increases, the overall amount of heat produced increases. However, since the mount (heatsink) 204 is semi-cylindrical, as shown in the example, the heat capacity increases, making effective heat dissipation possible. To further increase heat dissipation, a plurality of slits may be cut into the mount 204 in parallel, thus forming radiation fins.

Note that Embodiment 2 is the same as Embodiment 1 with regard to the first body 6 being rotatable relative to the base 4 in the direction of the arrows E around the central axis X, and with regard to the second body 203 being swingable relative to the first body 6 in the directions of the arrows M and N to an angle that exceeds 90 degrees in either direction. Therefore, a description of these similarities is omitted.

This concludes the description of embodiments of the present invention. The present invention is of course not limited to the above embodiments, however, and may for example be modified as follows.

(1) In the above embodiments, the swing axis is perpendicular to (i.e. in planar intersection with) the central axis X in the same plane. However, the swing axis and the central axis X need not intersect within the same plane. In other words, the shaft 104 may be perpendicular to the central axis X while being located at a distance from the central axis X.

(2) In the bulb-type LED lamp 2 of the above embodiments, the second body 8 can be swung around the shaft 104 (swing axis Y1), as shown in FIGS. 1A and 1B, to an angle exceeding 90 degrees both upwards (in the direction of arrow M) and downwards (in the direction of arrow N) with respect to the central axis X. Alternatively, the second body may be swingable to an angle exceeding 90 degrees in only one direction, either upwards or downwards. In this case, if the first body 6 is rotated once (360 degrees) around the base 4, the LED module 10 can always be directed perpendicularly downwards with respect to the socket of the lighting fixture not shown in the figures.

Figure 10A:
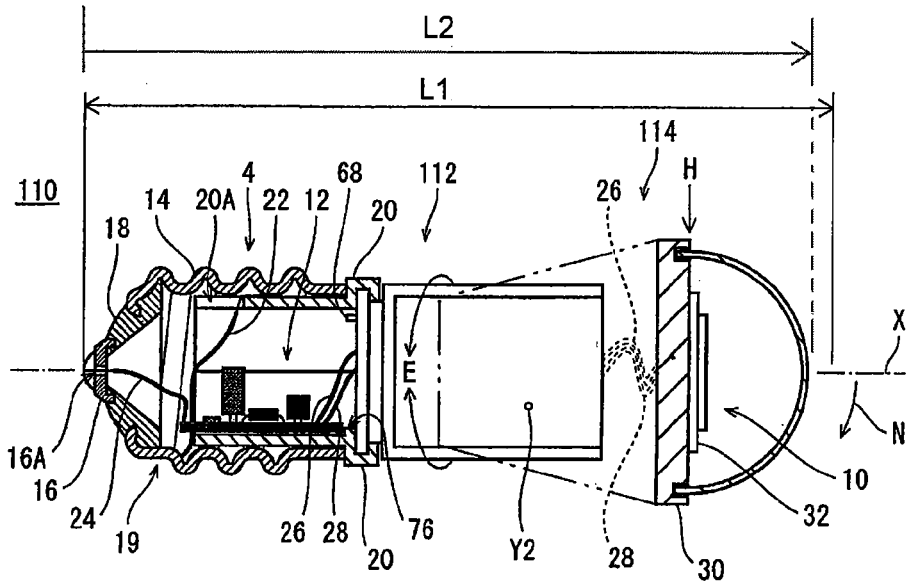
FIGS. 10A and 10B show a structure of a bulb-type LED lamp according to a Modification.
Figure 10B:
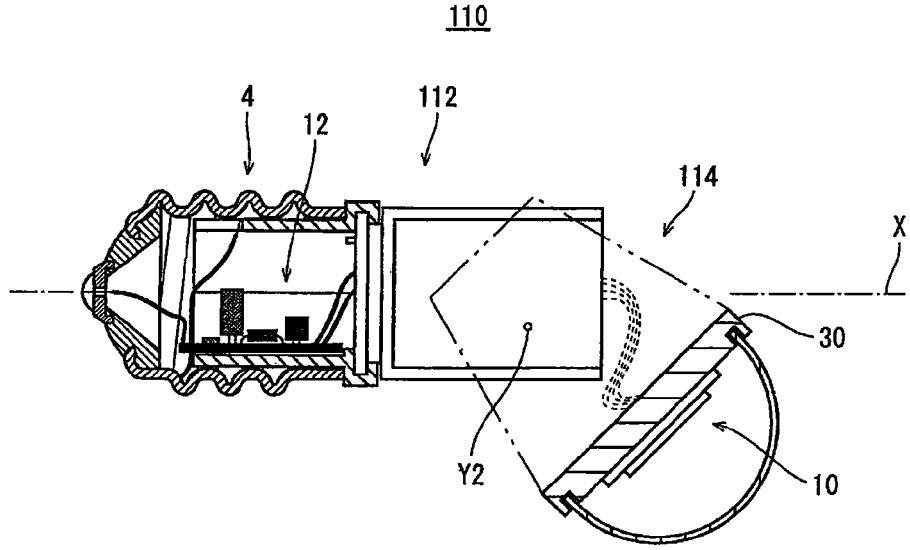

In this case, the swing axis of the second body 8 may be shifted towards the direction in which the second body 8 swings, rather than being in planar intersection with the central axis X. FIGS. 10A and 10B show a structure of a bulb-type LED lamp 110 that has been modified in this way. Note that FIGS. 10A and 10B have been drafted based on FIGS. 1A and 1B. Components that are substantially the same as in the bulb-type LED lamp 2 according to the above embodiments bear the same reference signs.

As shown in FIG. 10A, in the bulb-type LED lamp 110, a swing axis Y2 of a second body 114 with respect to a first body 112 is shifted from the central axis X towards the direction in which the second body 114 swings (towards the side of the arrow N). By shifting the swing axis Y2 from the central axis X in this way, when the second body 114 is positioned so that light is emitted in a direction parallel to the central axis X, as shown in FIG. 10A, the total length L2 of the bulb-type LED lamp 110 is shorter than the total length L1 of shown in FIG. 1A in Embodiment 1 (L2<L1). Accordingly, the bulb-type LED lamp becomes more compact. As the lamp becomes more compact, it becomes more usable in existing light fixtures.

Alternatively, if the total length is set as L1 when shifting the swing axis Y2 from the central axis X as above, then the area of the second body may be increased over a range corresponding to the length of (L1-L2). This improves heat dissipation, which reduces the temperature of the LED module, thus improving reliability. Alternatively, additional power may be provided to the LED module, thus achieving a bulb-type LED lamp with even higher luminous flux.

(3) In the above Embodiments, LEDs are described as an example of light-emitting elements, but the light-emitting elements in the light-emitting module are not limited in this way, and may for example be electroluminescent devices, field emission devices, etc.

Industrial Applicability

The bulb-type lamp according to the present invention is highly usable as a bulb-type LED lamp that replaces mini krypton bulbs, for example.

REFERENCE SIGNS LIST

2,110 bulb-type LED lamp
4 base
6, 112 first body
8, 114 second body
10 LED module
202 LED lamp
203 second body

The invention claimed is:

1. A bulb-type lamp comprising:

a base to be inserted into a socket by being rotated around a central axis of the base;

a first body attached to the base;

a second body attached to the first body; and a light-emitting module, which includes a printed substrate and at least one LED chip mounted on a principal surface of the printed substrate, is mounted on the second body, wherein with the base inserted into the socket, the first body is rotatable freely around the central axis, and the second body is swingable in a direction perpendicular to the central axis, and a swing axis of the second body is shifted away from the central axis of the base towards the direction in which the second body is swingable.

2. The bulb-type lamp of claim 1, further comprising:

a whirl-stop configured to prevent the first body from rotating more than once around the central axis when the base is inserted into the socket with the first body or the second body being held.

3. The bulb-type lamp of claim 2, wherein the second body is positioned with respect to the first body so that the principal surface is perpendicular to the central axis.

4. The bulb-type lamp of claim 1, further comprising:

a lead wire electrically connecting the base with the light-emitting module, wherein the first body includes a through-hole through which the lead wire passes, and the first body and the base are electrically insulated from each other.

5. A light-emitting diode (LED) lamp comprising:

a base configured to be insertable into a power supply socket to provide electrical power by rotation around a central axis of the base;

a first body attached to the base and rotatable relative to the base about the central axis of the base within a predetermined angle of rotation;

a second body attached to the first body and rotatable with the first body about the central axis of the base; and an LED module mounted on the second body for directing light, from the second body when powered, along an optical axis aligned with the central axis when the second body is aligned with the central axis, wherein the second body is mounted to the first body to additionally rotate relative to the first body and the base around a swing axis connecting the first body to the second body, the swing axis is offset from the central axis of the base towards the direction in which the second body is swingable to position the LED module to emit light perpendicular to the central axis, wherein the LED lamp is initially mounted into the power supply socket by rotation of the base to establish a power connection and the second body is rotated to direct light in a direction perpendicular to the central axis of the base.

* * * * *